US005207322A

United States Patent [19]

Focke et al.

[11] Patent Number: 5,207,322

[45] Date of Patent: May 4, 1993

[54] HINGE-LID PACK FOR CIGARETTES OR THE LIKE

[75] Inventors: Heinz Focke; Helmut Granz, both of Verden, Fed. Rep. of Germany

[73] Assignee: Focke & Co (GmbH & Co.), Verden, Fed. Rep. of Germany

[21] Appl. No.: 832,309

[22] Filed: Feb. 7, 1992

[30] Foreign Application Priority Data

Feb. 7, 1991 [DE] Fed. Rep. of Germany ..... 4103612

[51] Int. Cl.[5] ..... B65D 85/10

[52] U.S. Cl. ..... 206/268; 206/273

[58] Field of Search ..... 206/268, 273

[56] References Cited

U.S. PATENT DOCUMENTS

| | | | |
|---|---|---|---|
| 4,314,643 | 2/1982 | Forbes, Jr. . | |
| 4,466,536 | 8/1984 | Zeitel | 206/273 |
| 4,753,383 | 6/1988 | Focke et al. . | |
| 4,753,384 | 6/1988 | Focke et al. . | |
| 4,852,734 | 8/1989 | Allen et al. | 206/273 |

FOREIGN PATENT DOCUMENTS

| | | |
|---|---|---|
| 1161513 | 1/1964 | Fed. Rep. of Germany . |
| 87154749 | 11/1987 | Fed. Rep. of Germany . |
| 518117 | 6/1976 | U.S.S.R. . |
| 793369 | 10/1976 | U.S.S.R. . |
| 731887 | 4/1980 | U.S.S.R. . |
| 1223836 | 4/1986 | U.S.S.R. . |
| 776877 | 12/1957 | United Kingdom . |
| 819204 | 9/1959 | United Kingdom . |
| 2031380 | 4/1980 | United Kingdom . |
| 2151212 | 7/1985 | United Kingdom . |

*Primary Examiner*—William I. Price

*Attorney, Agent, or Firm*—Sughrue, Mion, Zinn, Macpeak & Seas

[57] ABSTRACT

A hinge-lid pack for cigarettes or the like. It is a common problem in hinge-lid packs comprising a pack part (10) and a lid (11) articulated on a rear panel (13) of the pack part (10), to reliably lock the lid (11) in an accurate closed position. This problem particularly appears in hinge-lid packs with rounded or bevelled longitudinal edges (27, 28). To ensure the precise closed position of the lid (11), material thickenings are formed in the region of the inner side of a lid front panel (17). In closed position, these thickenings exert an increased closing pressure on upper portions of a collar (23), particularly of a collar front panel (24). This closing pressure loads the lid (11) in the closed position.

4 Claims, 3 Drawing Sheets

HINGE-LID PACK FOR CIGARETTES OR THE LIKE

BACKGROUND OF THE INVENTION

The invention relates to a hinge-lid pack, especially with rounded or bevelled longitudinal edges, comprising a pack part and a lid articulated on a rear panel of the pack part, and including a collar which is arranged in the pack part and partially projects therefrom and which is surrounded, in a closed position, in the region of a collar front panel and collar side panels by a lid front panel and lid side panels of the lid.

Hinge-lid packs are commonly used as cigarette packs. The structure of this pack type is standardized in that a pack part and a lid are pivotably connected to one another. For this purpose, a lid rear panel is connected to a pack rear panel via a "hinge" formed by a folding line.

A collar comprising a collar front panel and collar side panels laterally adjoining thereto is arranged within the pack part. The collar is connected to the inner sides of a front panel and two adjoining side panels of the pack part. A portion of the collar projects from the pack part. In the closed position of the pack, this free portion of the collar is enclosed by the lid.

A certain problem in this type of pack is that, in the closed position, free edges of the lid (closing edge) do not precisely abut counter edges of the pack part in the region of front panel and side panels. Quite often, a gap is formed after the pack has been opened and re-closed, which is a result of restoring forces of the material.

This problem particularly appears in hinge-lid packs with rounded longitudinal edges according to U.S. Pat. No. 4,753,383 and in packs with bevelled or polygonal longitudinal edges (U.S. Pat. No. 4,753,384).

In order to lock the lid of a hinge-lid pack in the closed position, it is known in the art to provide an inner lid tab with lateral recesses which engage free edges of the collar front panel in the closed position. The positive connection of collar front panel and inner lid tab exerts an additional closing force on the lid.

SUMMARY OF THE INVENTION

The invention is based on the object to provide a further solution for securing the lid of a hinge-lid pack in the closed position which is easy in terms of production and which reliably applies an additional closing force to the lid, even if the hinge-lid pack has been opened and re-closed repeatedly.

To attain this object, the hinge-lid pack according to the invention is characterized in that the lid front panel is provided at its inner side with at least one material thickening which, in the closed position of the lid, abuts the collar front panel under an increased pressure.

The local pressure which is thus created between lid front panel and collar front panel stabilizes the closed position and avoids a gaping closing joint.

According to a further proposal of the invention, the additional closing pressure is created in a region which is located away from the closing edge of the lid, particularly in a region adjacent to a lid top panel and therewith in an end region of lateral legs of an appropriately designed collar front panel. As usual, this collar front panel comprises a central recess which facilitates an extraction of the pack contents. As a result, the collar front panel forms lateral webs which are connected to the collar side tabs. The additional closing pressure is created in the upper or end region of these webs by means of appropriate thickenings in the lid. In this region, the collar front panel has a higher stability because of the directly adjacent transversely directed collar side tabs.

According to the invention. folding tabs which are attached to the inner lid tab form the thickening. In particular, the folding tabs are in the form of transversely directed projections or extensions located at the edge of the inner lid tab. The folding tabs are inwardly folded against the side of the inner lid tab which confronts the lid front panel. In this configuration, the inner lid tab is joined to the lid front panel, in particular by means of adhesive bonding. According to the invention, the inwardly folded projections or extensions are arranged in a region directed towards the free edge of the inner lid tab, i.e. adjacent to a lid top panel.

An exemplary embodiment of the hinge-lid pack according to the invention will be described below with reference to the drawings, in which:

DESCRIPTION OF A PREFERRED EMBODIMENT

Figure 1:
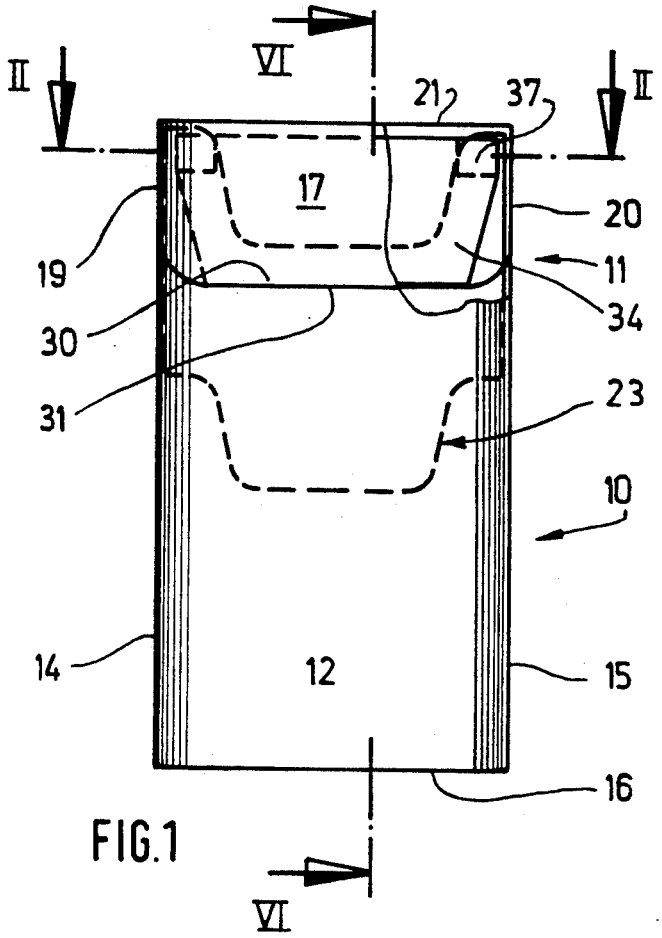
FIG. 1 is a front view of a hinge-lid pack with rounded longitudinal edges, partly broken away.

Hinge-lid packs mainly serve for holding cigarettes, particularly a cigarette group wrapped in an inner blank which is usually made of tin foil. The hinge-lid pack comprises a pack part 10 and a lid 11 which is pivotably connected to the pack part 10. The pack part 10 comprises a front panel 12, a rear panel 13, side panels 14 and 15 and a bottom panel 16.

In like manner, the lid 11 comprises a lid front panel 17, a lid rear panel 18, lid side panels 19 and 20 and a lid top panel 21. The latter is located opposite the bottom panel 16 of the pack part 10.

Pack part 10 and lid 11 are connected to one another in the region of rear panel 13 and lid rear panel 18, particularly in the region of a transversely directed folding line 22 which acts like a hinge when the lid 11 is opened and closed.

Figure 2:
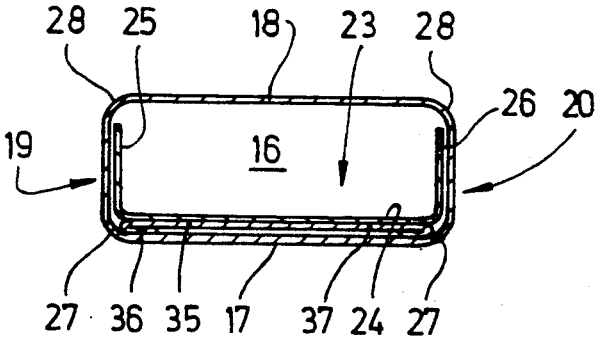
FIG. 2 is a horizontal section of the hinge-lid pack of FIG. 1, taken along the line II—II.
Figure 3:
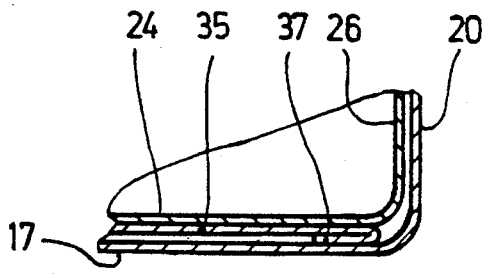
FIG. 3 shows a corner portion of the detail of FIG. 2, on an enlarged scale.

A conventionally designed hinge-lid pack also comprises a collar 23 which in this case is formed from a separate blank and comprises a collar front panel 24 and collar side tabs 25 and 26. The collar 23 is located in the pack part 10 in such a way that an upper portion of the collar 23 projects from this pack part 10. In the region of the collar front panel 24, the collar 23 is connected to the inner side of the front panel 12 of the pack part. The collar side tabs 25, 26 rest against the inner sides of the side panels 14, 15 of the pack part 10. In closed position, the portion of collar 23 which projects from the pack part 10 is enclosed by the lid 11, particularly by the lid front panel 17 and lid side panels 19, 20 (FIGS. 1 to 3).

The hinge-lid pack of the present exemplary embodiment is provided with specifically designed longitudinal edges 27 and 28, particularly with rounded longitudinal edges (round edges) as disclosed in U.S. Pat. No. 4,753,383. Accordingly, the collar 23 also comprises rounded collar edges 29 in the region between collar front panel 24 and collar side tabs 25, 26.

The hinge-lid pack is provided with special measures for securing the lid 11 in the closed position without impeding the general handling of the pack. In closed position, a lower free edge of the lid front panel 17, i.e. a lid edge 30, has to abut as precisely as possible a counter edge of the pack part 10, particularly an upper free edge of the front panel 12 of the pack part 10, i.e. in the present case a closing edge 31. To ensure this closed position (FIG. 1, FIG. 6), an additional closing pressure is exerted on the lid 11 in the present hinge-lid pack.

Inwardly directed material reinforcements or thickenings are formed within the lid and exert an increased (supporting) pressure on portions of the collar in the closed position. As a result, an additional closing force is applied to the lid 11. The increased pressure is created in the region of the collar front panel 24, and in the present embodiment particularly in an upper region directed towards a free edge of the collar front panel.

For this purpose, the invention makes use of the specific but nevertheless quite conventional structure of the collar 23. In the region of the collar front panel 24, the collar is provided with a recess 32 which is completely located in the portion of the collar which projects from the pack part 10. The recess 32 delimits lateral webs 33, 34 of the collar front panel 24. The webs form narrow surface areas of the collar front panel which slightly taper towards the top. In the closed position of the lid 11, said material thickenings at the inner side of the lid front panel abut the collar front panel in the region of the webs 33, 34. In particular, they abut the upper or free ends of the webs 33, 34 directly adjacent to the lateral edges and the collar side tabs 25, 26 adjoining these edges.

Figure 4:
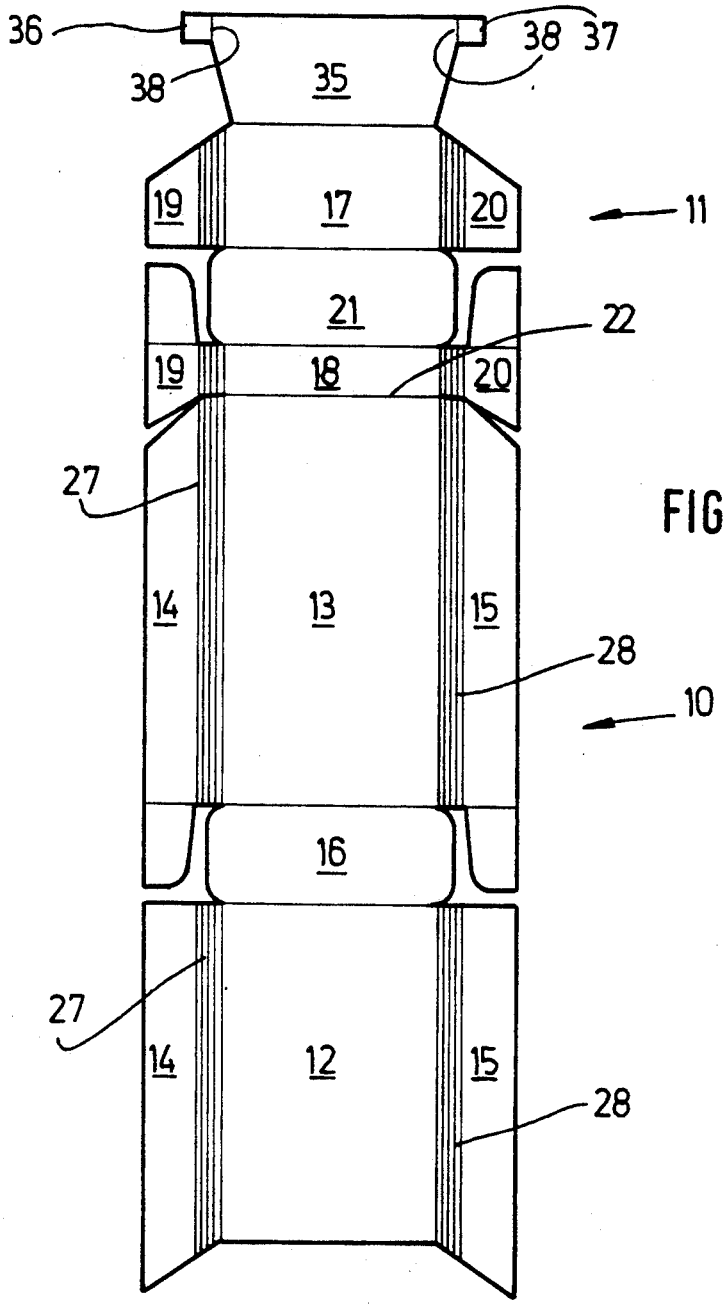
FIG. 4 shows a spread-out blank for a hinge-lid pack according to FIG. 1.
Figure 5:
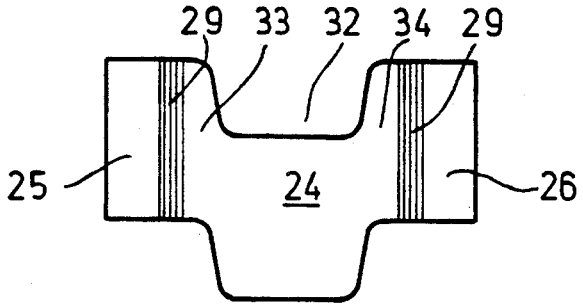
FIG. 5 shows a collar blank for a hinge-lid pack.
Figure 6:
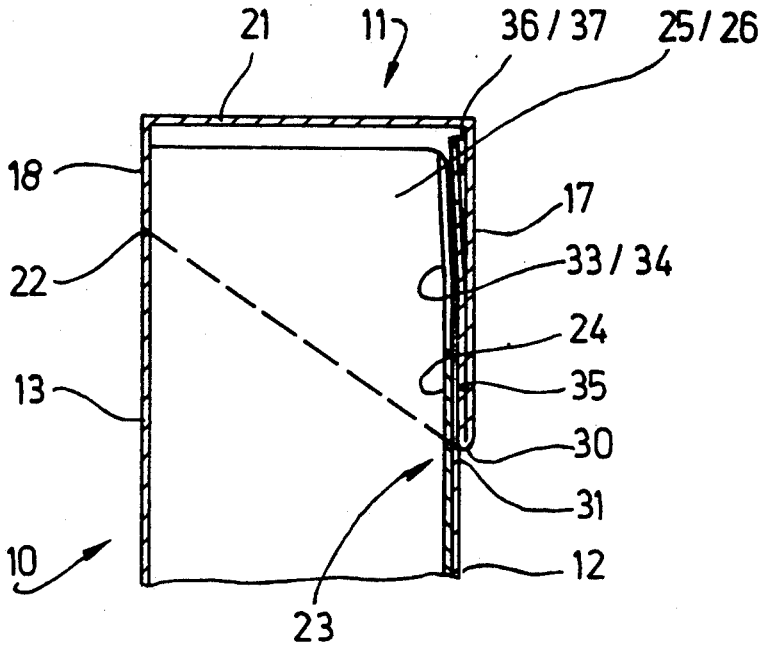
FIG. 6 is a vertical section taken along the line VI—VI of FIG. 1 showing an upper portion of the hinge-lid pack of FIG. 1 on an enlarged scale.
Figure 7:
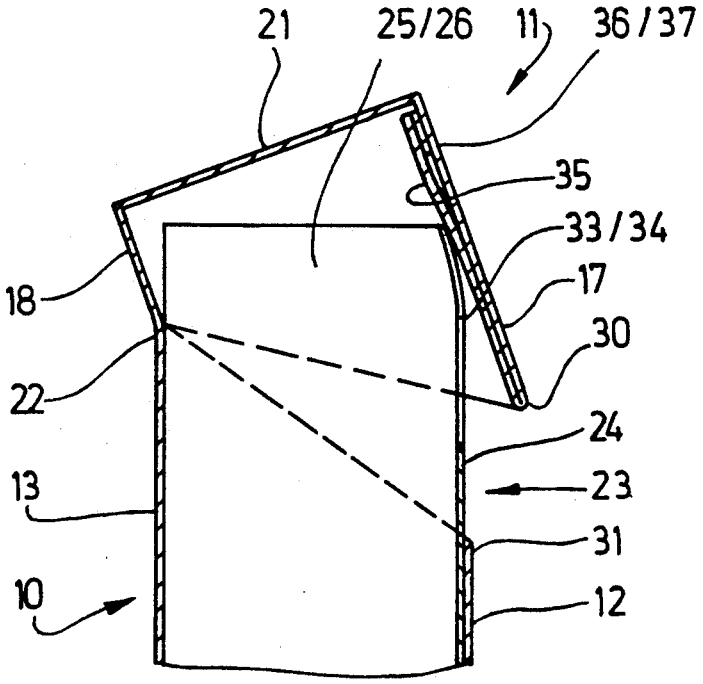
FIG. 7 shows the detail of FIG. 6 during an opening phase.

The material thickening can be formed in different ways, particularly also by means of separate blanks which are placed on the inner side of the lid front panel 17. Expediently, the thickenings are disposed in the region between the lid front panel 17 and an inner lid tab 35. In principle, this inner lid tab 35 is quite common in hinge-lid packs. The inner lid tab 35 is part of the pack blank (FIG. 4) and adjoins the free edge of the lid front panel 17. In the present case, however, the inner lid tab 35 has a greater dimension in the longitudinal direction of the blank, such that the inner lid tab 35 extends nearly up to the inner side of the lid top panel 21 (FIGS. 6 and 7).

In the present embodiment, the material thickening is formed from portions of the inner lid tab 35, particularly from small folding tabs 36, 37 which are part of the pack blank and laterally adjoin the free end of the inner lid tab 35 in the form of extensions. In the present embodiment, the folding tabs 36, 37 are square and are delimited from the inner lid tab 35 by a folding line 38. The inner lid tab 35 itself has a trapezoidal shape.

To form the described material thickenings, the folding tabs 36, 37 are folded against the side of the inner lid tab 35 which confronts the lid front panel 17 and are expediently connected thereto by adhesive bonding. Thereafter, the folding process continues in the normal way and the inner lid tab 35 is folded against the inner side of the lid front panel 17 and is also adhesively bonded thereto. As a result, the inner lid tab 35 directly abuts the lid front panel 17 in a central region. The thickenings are formed by the folding tabs 36, 37 in the lateral regions between inner lid tab 35 and lid front panel 17. The folding tabs 36, 37 precisely extend in the region of the ends of the webs 33, 34.

As a result of the outwardly directed closing force exerted on the lid front panel 17, the lid 11 is loaded in the direction of the closed position. This is also a result of the fact that the lid 11 acts like a lever which is pivoted on the hinge (folding line 22) and is loaded in the closing direction. Consequently, it is important that the material thickenings are arranged above the folding line 22.

We claim:

1. A hinge-lid pack, with rounded or bevelled longitudinal edges (27, 28), comprising a pack part (10) and a lid (11) articulated on a rear panel (13) of the pack part (10), and including a collar (23) which is arranged in the pack part (10) and partially projects therefrom and which is surrounded, in a closed position, in the region of a collar front panel (24) and collar side panels (25, 26) by a lid front panel (17) and lid side panels (19, 20) characterized in that the lid front panel (17) is provided at its inner side with at least one material thickening which, in the closed position of the lid (11), abuts the collar front panel (24) and creates an increased closing pressure;

wherein the thickening at the inner side of the lid front panel (17) is located at a distance from a free lid edge (30) of said lid front panel (17), directly adjacent to a lid top panel (21);

wherein the thickening abuts the collar front panel (24) in the region of lateral legs or webs (33, 34) of the collar front panel (24);

wherein the thickening is formed from an inner lid tab (35) at the inner side of the lid front panel (17), by means of a local two-ply design of the inner lid tab (35); and wherein folding tabs (36, 37) which are attached to the inner lid tab (35) are folded between the inner lid tab (35) and the lid front panel (17) in order to form the thickenings.

2. A hinge-lid pack, with rounded or bevelled longitudinal edges (27, 28), comprising a pack part (10) and a lid (11) articulated on a rear panel (13) of the pack part (10), and including a collar (23) which is arranged in the pack part (10) and partially projects therefrom and which is surrounded, in a closed position, in the region of a collar front panel (24) and collar side panels (25, 26) by a lid front panel (17) and lid side panels (19, 20), characterized in that the lid front panel (17) is provided at its inner side with at least one material thickening which, in the closed position of the lid (11), abuts the collar front panel (24) and creates an increased closing pressure;

wherein the thickening at the inner side of the lid front panel (17) is located at a distance from a free lid edge (30) of said lid front panel (17), directly adjacent to a lid top panel (21);

wherein the thickening abuts the collar front panel (24) in the region of lateral legs or webs (33, 34) of the collar front panel (24);

wherein the thickening is formed from an inner lid tab (35) at the inner side of the lid front panel (17), by means of a local two-ply design of the inner lid tab (35); and wherein two thickenings are arranged at the inner side of the lid front panel (17) in lateral regions which are directed towards the lid top panel (21), such that, in the closed position of the lid (11), said thickenings abut upper or free end portions of the webs (33, 34) of the collar front panel (24).

3. The hinge-lid pack as claimed in claim 2, wherein folding tabs (36, 37) laterally adjoin the inner lid tab (35), especially on a level with a free edge confronting the lid top panel (21), and wherein said folding tabs (36, 37), in order to form the thickenings, are inwardly foldable against the inner lid tab (35) in such a way that said folding tabs (36, 37) are fixed between inner lid tab (35) and lid front panel (17).

4. The hinge-lid pack as claimed in claim 3, wherein the inner lid tab (35) is designed trapezoidally, with edges which diverge towards the free edge.

* * * * *